US006276989B1

(12) United States Patent
Campbell et al.

(10) Patent No.: US 6,276,989 B1
(45) Date of Patent: Aug. 21, 2001

(54) METHOD AND APPARATUS FOR CONTROLLING WITHIN-WAFER UNIFORMITY IN CHEMICAL MECHANICAL POLISHING

(75) Inventors: W. Jarrett Campbell; Jeremy Lansford; Christopher H. Raeder, all of Austin, TX (US)

(73) Assignee: Advanced Micro Devices, Inc., Austin, TX (US)

( * ) Notice: Subject to any disclaimer, the term of this patent is extended or adjusted under 35 U.S.C. 154(b) by 0 days.

(21) Appl. No.: 09/372,014

(22) Filed: Aug. 11, 1999

(51) Int. Cl.[7] ..... B24B 49/00

(52) U.S. Cl. ..... 451/10; 451/11; 451/41; 451/54; 451/63; 451/285; 451/287

(58) Field of Search ..... 451/9, 10, 11, 451/8, 41, 54, 59, 63, 285, 287, 288, 56, 443, 5

(56) References Cited

U.S. PATENT DOCUMENTS 5,851,135 * 12/1998 Sandhu et al. ..... 451/5
6,093,651 * 7/2000 Andideh et al. ..... 451/287
6,120,348 * 9/2000 Fujita et al. ..... 451/287
6,146,241 * 11/2000 Lee et al. ..... 451/288
6,159,075 * 12/2000 Zhang ..... 451/287

OTHER PUBLICATIONS

Boning et al., "Practical issues in run by run process control," Proceeding of Advanced Semiconductor Manufacturing Conference, 1995.

* cited by examiner

*Primary Examiner*—Eileen P. Morgan
(74) *Attorney, Agent, or Firm*—Williams, Morgan & Amerson, P.C.

(57) ABSTRACT

A method of controlling surface non-uniformity of a process layer includes receiving a first lot of wafers, and polishing a process layer of the first lot of wafers. A control variable of the polishing operations is measured after the polishing is performed on the process layer. A first adjustment input for an arm oscillation length of a polishing tool is determined based on the measurement of the control variable. A process layer of a second lot of wafers is polished using the adjustment input for the arm oscillation length. A controller for controlling surface non-uniformity of a process layer includes an optimizer and an interface. The optimizer is adapted to determine a first adjustment input for arm oscillation length of a polishing tool based on a measurement of a control variable from a first lot of wafers. The interface is adapted to provide the first adjustment input to the polishing tool for polishing a second lot of wafers.

28 Claims, 8 Drawing Sheets

METHOD AND APPARATUS FOR CONTROLLING WITHIN-WAFER UNIFORMITY IN CHEMICAL MECHANICAL POLISHING

BACKGROUND OF THE INVENTION

1. Field of the Invention

This invention relates generally to the planarization of semiconductor wafers, and more particularly, to a method and apparatus for controlling within-wafer uniformity in chemical mechanical polishing.

2. Description of the Related Art

Chemical mechanical polishing (CMP) is a widely used means of planarizing silicon dioxide as well as other types of layers on semiconductor wafers. Chemical mechanical polishing typically utilizes an abrasive slurry disbursed in an alkaline or acidic solution to planarize the surface of the wafer through a combination of mechanical and chemical action. Generally, a chemical mechanical polishing tool includes a polishing device positioned above a rotatable circular platen or table on which a polishing pad is mounted. The polishing device may include one or more rotating carrier heads to which wafers may be secured, typically through the use of vacuum pressure. In use, the platen may be rotated and an abrasive slurry may be disbursed onto the polishing pad. Once the slurry has been applied to the polishing pad, a downward force may be applied to each rotating carrier head to press the attached wafer against the polishing pad. As the wafer is pressed against the polishing pad, the surface of the wafer is mechanically and chemically polished.

As semiconductor devices are scaled down, the importance of chemical mechanical polishing to the fabrication process increases. In particular, it becomes increasingly important to control and minimize within-wafer topography variations. For example, in one embodiment, to minimize spatial variations in downstream photolithography and etch processes, it is necessary for the oxide thickness of a wafer to be as uniform as possible (i. e., it is desirable for the surface of the wafer to be as planar as possible.)

Those skilled in the art will appreciate that a variety of factors may contribute to producing variations across the post-polish surface of a wafer. For example, variations in the surface of the wafer may be attributed to drift of the chemical mechanical polishing device. Typically, a chemical mechanical polishing device is optimized for a particular process, but because of chemical and mechanical changes to the polishing pad during polishing, degradation of process consumables, and other processing factors, the chemical mechanical polishing process may drift from its optimized state.

Generally, within-wafer uniformity variations (i.e., surface non-uniformity) are produced by slight differences in polish rate at various positions on the wafer. FIG. 1 illustrates two radial profiles of surface non-uniformity typically seen after an oxide polish of a wafer. The dished topography is often referred to as a center-fast polishing state because the center of the wafer polishes at a faster rate than the edge of the wafer. The domed topography is designated center-slow because the center of the wafer polishes at a slower rate than the edge of the wafer. For obvious reasons, the dished topography may also be referred to as edge-slow, and the domed topography may also be referred to as edge-fast.

In addition to process drift, pre-polish surface non-uniformity of the wafer may also contribute to producing variations across the post-polish surface of the wafer. For example, prior to being polished, the radial profile of the wafer may be non-uniform (e.g., the surface may exhibit characteristics that are center-fast, center-slow, etc.), and the post-polish surface non-uniformity of the wafer may be exacerbated by the pre-polish condition of the wafer.

The present invention is directed to overcoming, or at least reducing the effects of, one or more of the problems set forth above.

SUMMARY OF THE INVENTION

In one aspect of the present invention, a method of controlling surface non-uniformity of a process layer is provided. The method includes receiving a first lot of wafers, and polishing a process layer of the first lot of wafers. A control variable of the polishing operations is measured after the polishing is performed on the process layer. A first adjustment input for an arm oscillation length of a polishing tool is determined based on the measurement of the control variable. A process layer of a second lot of wafers is polished using the adjustment input for the arm oscillation length.

In another aspect of the present invention, a controller for controlling surface non-uniformity of a process layer is provided The controller includes an optimizer and an interface. The optimizer is adapted to determine a first adjustment input for arm oscillation length of a polishing tool based on a measurement of a control variable from a first lot of wafers. The interface is adapted to provide the first adjustment input to the polishing tool for polishing a second lot of wafers.

BRIEF DESCRIPTION OF THE DRAWINGS

The invention may be best understood by reference to the following description taken in conjunction with the accompanying drawings, in which like reference numerals identify like elements, and in which.

Figure 1:
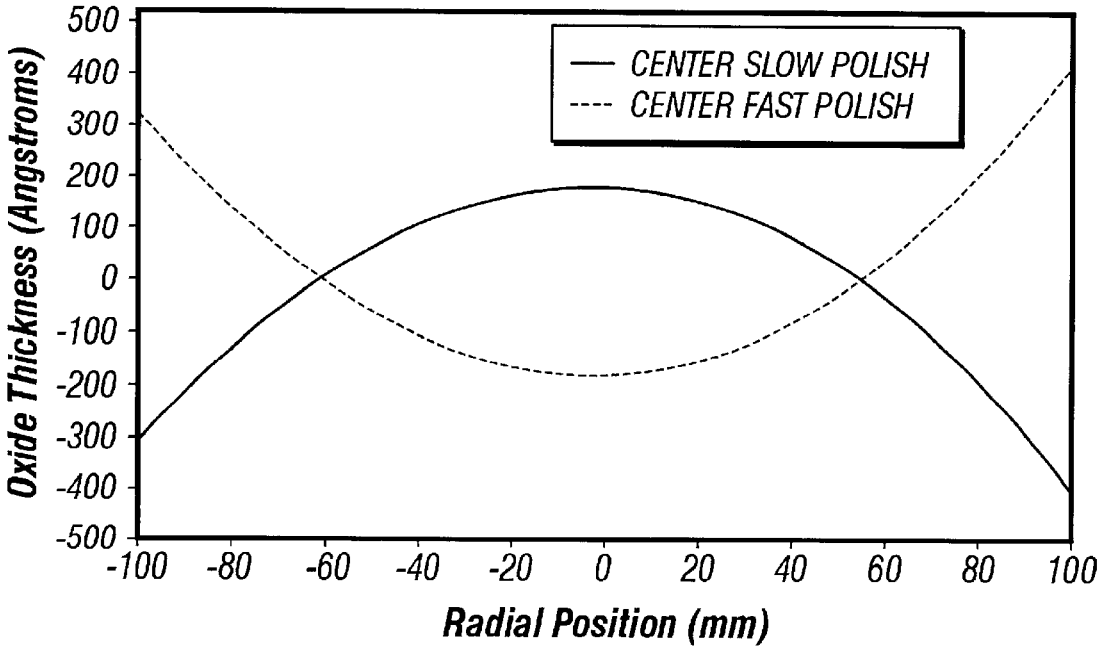
FIG. 1 (Prior Art)
FIG. 1 is a graph illustrating surface non-uniformity of a wafer.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Figure 2:
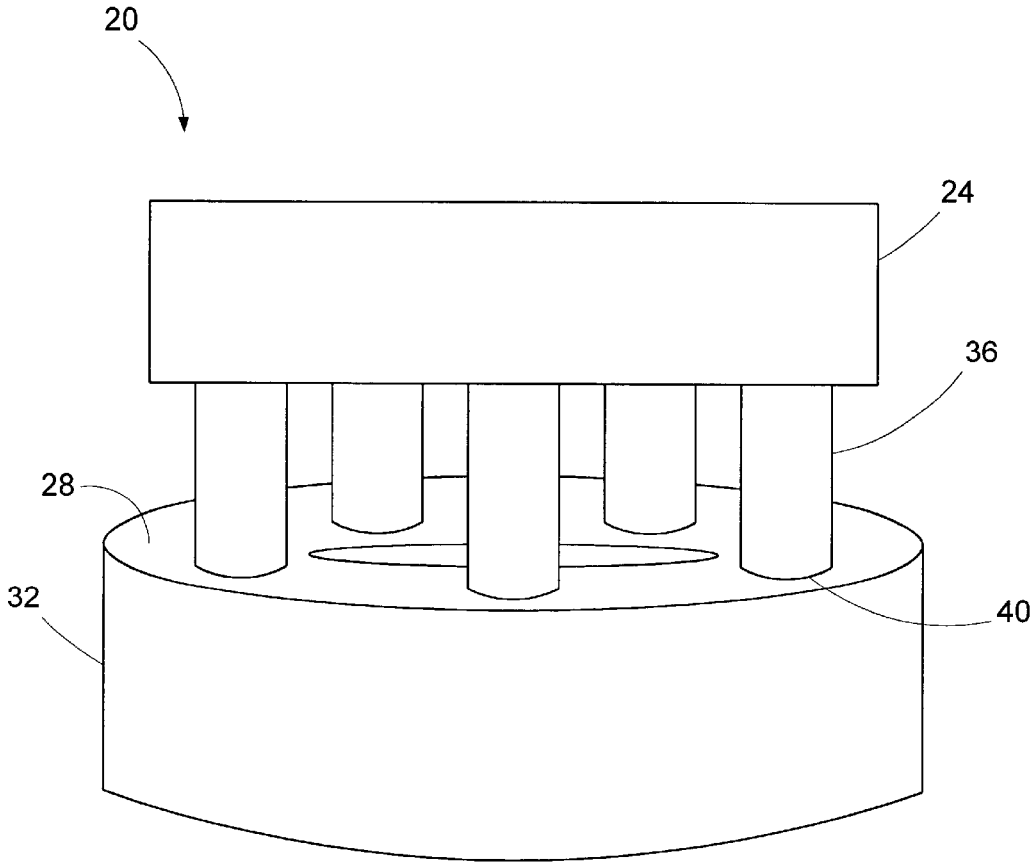
FIG. 2 illustrates a conventional polishing tool having multiple arms.

Referring to FIG. 2, an exemplary multiple arm polishing tool 20 is shown. The exemplary polishing tool 20 may be comprised of a multi-head carrier 24 positioned above a polishing pad 28 that is mounted on a platen 32. The multi-head carrier 24 typically includes a plurality of rotatable polishing arms 36, each of which includes a head 40. Wafers (not shown) may be secured to the carrier heads 40 using known techniques, such as vacuum pressure. A source of polishing fluid (not shown) may be provided to supply polishing fluid (e.g., slurry) to the polishing pad 28. Furthermore, although five polishing arms 36 are shown, it is contemplated that the polishing tool 20 may be comprised of any number of polishing arms 36. For example, in one embodiment, the polishing tool 20 is comprised of only a single polishing arm 36, and each wafer is polished individually.

To effectuate polishing, the platen 32 may be rotated at a typically constant table speed. Moreover, individually variable downward forces may be applied to each of the polishing arms 36, and the polishing arms 36 may be rotated and oscillated back and forth across the polishing pad 28. Conventionally, to control the surface non-uniformity of production wafers, the polishing tool 20 is taken out of production and adjusted to center the process around a desired result (i.e., the polishing tool 20 may be adjusted to produce wafers with a more uniform polished surface.) These adjustments may be determined by running a series of monitor wafers on the polishing tool 20 and adjusting the polishing tool 20 according to the measured surface non-uniformity of the polished layer of the wafers. Once adjusted, the polishing tool 20 is placed back into production, and the post-polish surfaces of the production wafers are monitored for desired uniformity.

Rather than continually removing the polishing tool 20 from production, it is contemplated that a control variable may be identified, and the polishing tool 20 may be manipulated based on the control variable to predictably control within-wafer non-uniformity of production wafers. Moreover, a variety of control variables may be used to characterize the state of the polishing process (e.g., center-fast, center-slow, etc.), and the particular control variable selected may vary depending upon the application. In one embodiment, the control variable is the slope of the center-to-edge radial polish rate profile (i.e. polish rate slope.)

Figure 3:
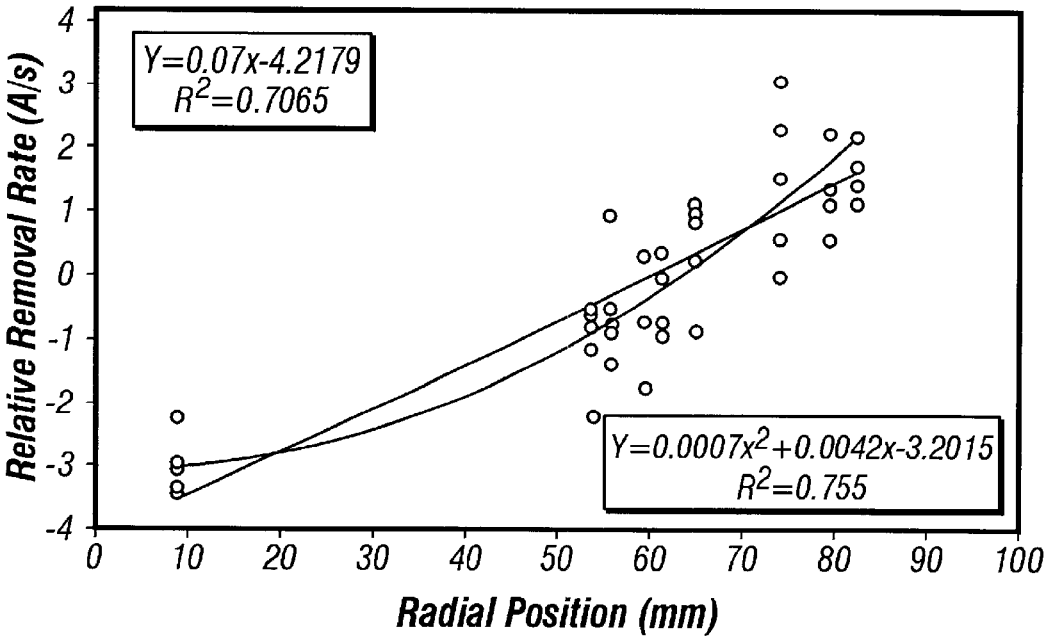
FIG. 3 is a graph illustrating center-to-edge polish rate profiles.

Referring to FIG. 3, the center-to-edge radial polish rate profile for a batch of five wafers is shown. It is contemplated that the pre-polish and post-polish thickness of the polished layer may be measured at a plurality of radial positions along the wafer. Once measured, the polish rate at these radial positions may be determined by comparing the post-polish and pre-polish measurements and both quadratic and linear polynomials may be fit to the polish rate profile. In one embodiment, the state of the polishing tool 20 (e.g., center-fast, center-slow, etc.) may be characterized by the slope of the linear curve fit (ie., polish rate slope.) For example, a positive slope of the radial polish rate profile indicates center-slow polishing while a negative slope indicates center-fast polishing.

An input variable of the polishing tool 20 may be selected that has a strong and predictable impact on the controlled variable, (e.g., polish rate slope.) Moreover, it is important that manipulation of the selected input variable not significantly impact the mean polish rate (i.e., the input variable must control surface non-uniformity of the wafer without substantially affecting the mean thickness of the polished layer.) In one embodiment, the input variable is the oscillation length of the polishing arms 36 (ie., arm oscillation length.)

Figure 4:
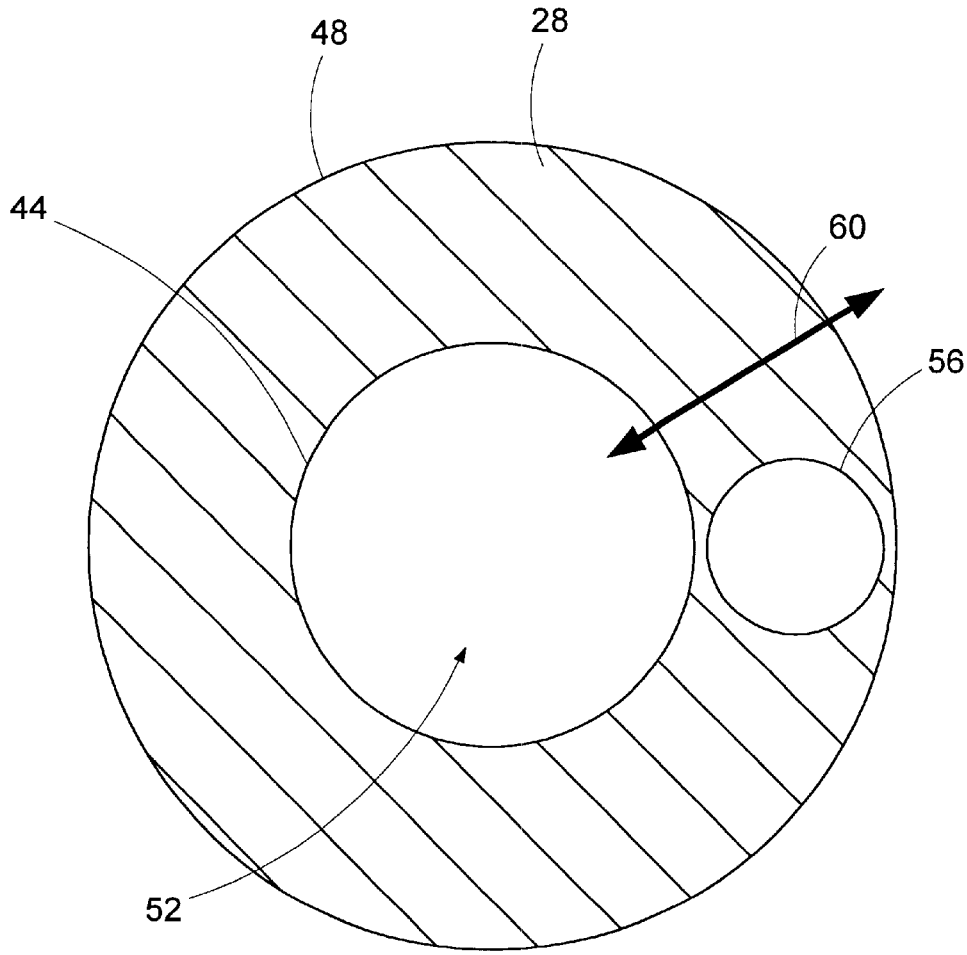
FIG. 4 is a simplified top-view of the polishing tool, shown in FIG. 2, illustrating control of arm oscillation length in accordance with one embodiment of the present invention.

Referring to FIG. 4, a top-view of the polishing pad 28 is shown. The polishing pad 28 may include an inner edge 44, an outer edge 48, and have an opening 52 positioned therein. Moreover, a wafer 56 is shown positioned against the polishing pad 28 between the inner and outer edge 44, 48. For simplicity, the polishing arms 36 and other elements of the polishing tool 20 are not shown. In addition, those skilled in the art will appreciate that a plurality of wafers 56 may be polished at the same time, and that FIG. 4 is a simplified view of the polishing pad 28 to aid in illustrating the present invention.

During the polishing process, the wafer 56 may oscillate back and forth across the polishing pad 28. The direction of the oscillation is indicated by arrow 60. Normally, the arm oscillation length may be adjusted such that a portion of the wafer 56 moves slightly off the inner edge 44 of the polishing pad 28 at the minimum point of oscillation and slightly off the outer edge 48 of the polishing pad 28 at the maximum point of oscillation. Moreover, when part of the wafer 56 is no longer in contact with the polishing pad 28 mechanical abrasion is halted, and the center area of the wafer 56, still in contact with the polishing pad 28, continues to polish while the edge of the wafer 56 no longer in contact with the polishing pad 28 does not polish. The arm oscillation length may be adjusted, and by increasing or decreasing the portion of the wafer 56 that moves off of the polishing pad 28 at the minimum and maximum points of oscillation, the center-to-edge polish rate may be adjusted. For example, if an increase in center polish rate is desired (e g, center-fast), the arm oscillation length may be increased. Likewise, decreasing the arm oscillation length may reduce the portion of the wafer 56 leaving the polishing pad 28 at the minimum and maximum points of oscillation, thus, increasing the edge polish rate (e.g., center-slow.)

In one illustrative embodiment, the wafer 56 has a diameter of 8 inches and is positioned equal distance between the inner edge 44 and outer edge 48 of the polishing pad 28. In this position, the wafer 56 is located ½ inch from both the inner and outer edge 44, 48 of the polishing pad 28 (i.e., the polishing pad 28 has a width of 9 inches.) However, those skilled in the art will appreciate that the dimensions of the wafer 56, the dimensions of the polishing pad 28, the position of the wafer 56, and the arm oscillation length may vary depending upon the application. The polishing tool 20 may also be adjusted to allow for increases and decreases in arm oscillation length in response to surface non-uniformity of the wafer 56 (i.e., the arm oscillation length may be centered between the minimum and maximum limits of oscillation.) For example, in one embodiment, the arm oscillation length may be varied between 0 and 4 inches, and the initial arm oscillation length is set to 2 inches. With the arm oscillation length at 2 inches, the wafer 56 extends ½ an inch off the polishing pad 28 at both the minimum and maximum points of oscillation. In this embodiment, to compensate for center-fast polishing, the arm oscillation length may be incrementally decreased from 2 inches to 0 inches, and to compensate for center-slow polishing, the arm oscillation length may be incrementally increased from 2 inches to 4 inches.

As stated above, it is important that manipulation of the arm oscillation length not substantially impact the mean polish rate (i.e., it is desirable for the input variable to control surface non-uniformity without substantially affecting the mean thickness of the polished layer.) Those skilled in the art will appreciate that mean polish rate $$\frac{\ddot{A}x}{\ddot{A}t}$$

may be understood with reference to Preston's equation, which is defined as:

$$\frac{\ddot{A}x}{\ddot{A}t} = Kp * \frac{F}{A} * v \tag{1}$$

where $$\frac{\ddot{A}x}{\ddot{A}t}$$

is the time averaged removal rate, F is the force applied, A is the area between the wafer 56 and the polishing pad 28, v is the relative linear velocity of the wafer 56, and Kp is an empirically determined scale factor. Because the same force F is constantly applied while polishing the wafer 56, the mean polish rate is not affected by changes in arm oscillation length. For example, when part of the wafer 56 is off of the polishing pad 28 (e.g., at the minimum and maximum limits of oscillation), the force associated with this area is distributed across the portion of the wafer 56 still in contact with the polishing pad 28. As a result, the polish rate associated with the portion of the wafer 56 still in contact with the polishing pad 28 increases. Moreover, because the wafer material no longer in contact with the polishing pad 28 is not being removed, the mean polish rate of the wafer 56 remains substantially the same (i.e., the polish rate is being proportionally increased and decreased on different areas of the wafer 56.)

In some applications, using the arm oscillation length as the only manipulated input variable limits the ability to control surface non-uniformity. For example, once the arm oscillation length reaches its minimum limit of 0 (i.e., the arm is stationary), it is not possible to continue to increase the edge polish rate by decreasing the arm oscillation length. Alternatively, once the arm oscillation length reaches its maximum limit, it is not possible to continue to increase the center polish rate by increasing the arm oscillation length. Therefore, a second manipulated input variable may be used to keep the arm oscillation length centered at a nominal value, thus, allowing latitude to increase or decrease the arm oscillation length in response to surface non-unifonnity of a process layer of the wafer 56. In one embodiment, the second manipulated variable may be the conditioning pad center position.

Figure 5:
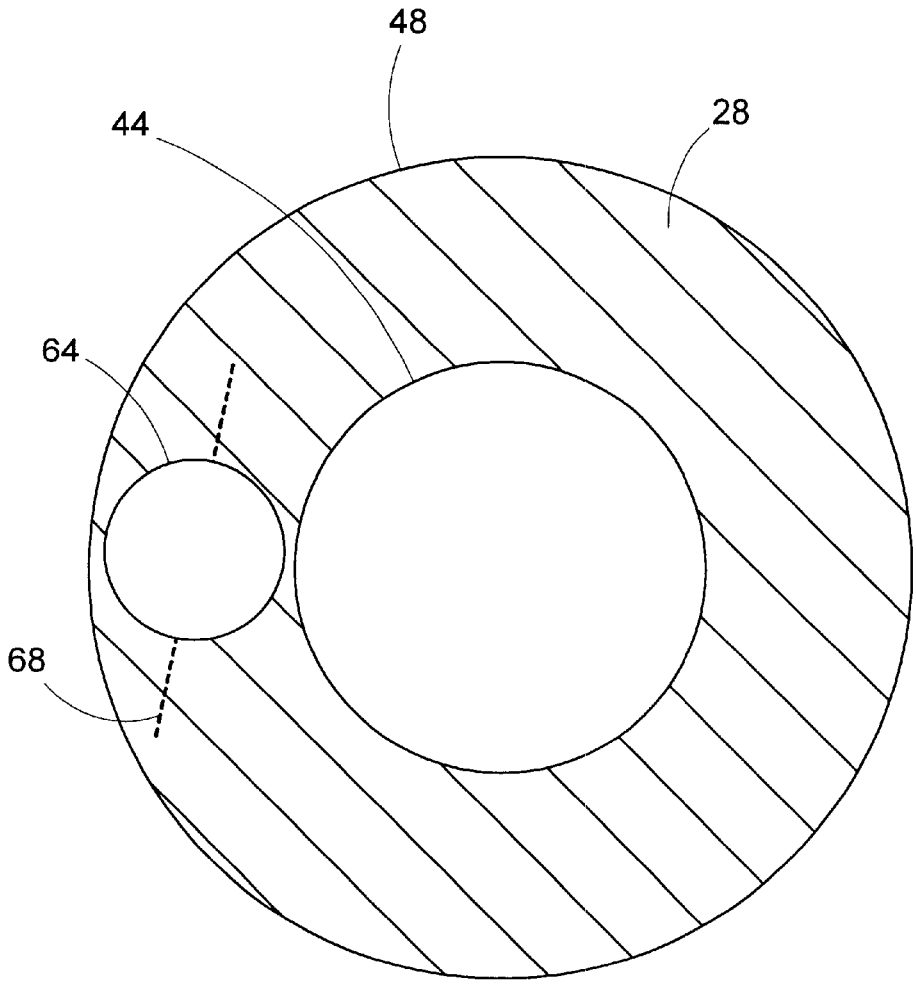
FIG. 5 is a simplified top-view of the polishing tool, shown in FIG. 2, illustrating control of conditioning pad position in accordance with one embodiment of the present invention.

Referring to FIG. 5, the polishing pad 28 is shown having a conditioning pad 64 positioned between the inner and outer edge 44, 48. Generally, the conditioning pad 64 is comprised of an abrasive diamond-impregnated plate, and as will be described below, the center position of the conditioning pad 64 may be varied as a matter of design choice to change the polishing characteristics of the polishing pad 28. For example, those skilled in the art will appreciate that while polishing, material may be abraded away from the surface of the wafer 56 and deposited on the surface of the polishing pad 28. The build up of waste material on the surface of the polishing pad 28 is commonly referred to as glazing. Glazing may, among other things, degrade the porosity of the polishing pad 28 reducing the flow of slurry to the polishing process, thus, reducing the effectiveness of the polishing pad 28. Generally, glazing may be more severe in different regions of the polishing pad 28 resulting in uneven polishing and surface non-uniformity of the wafer 56. For example, heavily glazed areas of the polishing pad 28 may be less effective when polishing than those areas of the polishing pad 28 that are not as heavily glazed.

Those skilled in the art will appreciate that the conditioning pad 64 may be used during a conditioning process to abrade the surface of the polishing pad 28 to reduce glazing (ie., the conditioning pad 64 may be used to remove the waste material from the surface of the polishing pad 28.) The center position of the conditioning pad 64, shown by the illustrative dotted line 68, may be manipulated so as to preferentially condition the polishing pad 28. For example, by changing the center position of the conditioning pad 64, the polishing pad 28 may remain glazed in some regions while other regions are substantially more conditioned. In one embodiment, preferential conditioning of the polishing pad 28 results in a gradient in polish rate across the radius of the polishing pad 28. For example, depending upon the direction of the gradient, the polishing pad 28 may produce wafers 56 having radial polish rate profiles that are either center-fast or center-slow. As a result, the polishing pad 28 may be preferentially conditioned to produce a desired gradient (e.g., center-fast, center-slow, etc.)

In one embodiment, if the arm oscillation length becomes constrained by its minimum or maximum limits, the center position of the conditioning pad 64 may be adjusted from its initial position, and the arm oscillation length may be re-centered between the minimum and maximum limits of oscillation (e.g., 2 inches.) For example, moving the center position of the conditioning pad 64 toward the outer edge 48 of the polishing pad 28 may produce a center-fast polishing profile. Alternatively, moving the center position of the conditioning pad 64 toward the inner edge 44 of the polishing pad 28 may produce a center-slow polishing profile. It is contemplated that the movement of the conditioning pad 64 from its initial position may vary depending upon the application and the type of polishing device 20. In one embodiment, the center position of the conditioning pad 64 may be moved 1 inch from its initial position in either direction, which results in a total range of movement of 2 inches.

Generally, the polishing pad 28 is conditioned with the conditioning pad 64 between each polish run. For example, once a single or a batch of wafers 56 is polished, the polishing pad 28 is conditioned before the next wafer or batch of wafers 56 is polished. Moreover, it is contemplated that the initial center position of the conditioning pad 64 may vary depending upon the particular polishing process. In one embodiment, the initial center position of the conditioning pad 64 is experimentally determined using test wafers 56. Moreover, once the center position of the conditioning pad 64 is moved from its initial position, the polishing pad 28 may require several polishing runs to reach a new steady-state gradient in polish rate. Furthermore, because adjusting the center position of the conditioning pad 64 may have an impact on mean polish rate, in one embodiment, the center position of the conditioning pad 64 is moved only when necessary to re-center the arm oscillation length. For example, if surface non-uniformity may be adjusted with arm oscillation length only (e.g., arm oscillation length is not at its maximum or minimum limit), the center position of the conditioning pad 64 is not manipulated.

Figure 6:
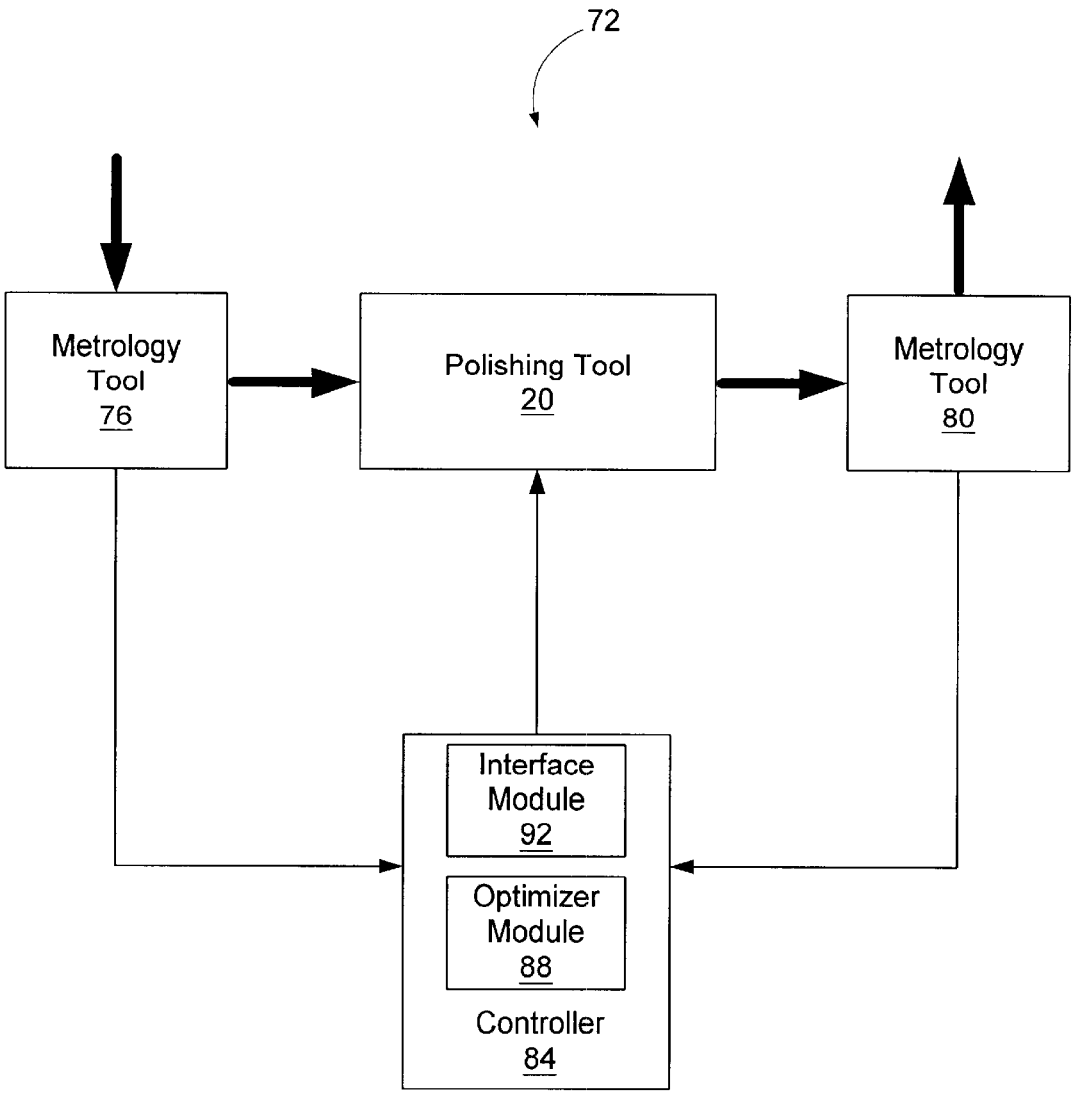
FIG. 6 illustrates an exemplary polishing system in accordance with one embodiment of the present invention.

Referring to FIG. 6, an exemplary system 72 for controlling the polishing tool 20 is shown. The exemplary system 72 includes a first and second metrology tool 76, 80 for measuring pre-polish thickness and post-polish thickness of process layers (e.g., dielectric layers, metal layers, etc.), respectively. Those skilled in the art will appreciate that although two metrology tools 76, 80 are shown, a single metrology tool may be used to perform both pre-polish and post-polish thickness measurements. The two metrology tools 76, 80 may be coupled to the polishing tool 20, and a suitable metrology tool 76, 80 for many applications is the Optiprobe® metrology tool manufactured by Therma-Wave, Inc. The system further includes a controller 84 coupled to the polishing tool 20. The controller 84 may receive pre-polish and post-polish thickness measurements from the metrology tools 76, 80, which may be used to control the polishing tool 20. Moreover, the controller 84 may be implemented using a variety of software applications. For example, the controller may be a model predictive controller implemented using MatLab Optimization Toolbox® routines.

In one embodiment, the controller 84 includes an optimizer module 88 and an interface module 92. As will be described below, the optimizer module 88 may be used to produce a desired radial polish rate profile (e.g, polish rate slope) in the post-polish surface topology of a wafer (not shown). For example, the optimizer module 88 may be used to determine the arm oscillation length and the center position of the conditioning pad 64 that minimizes the surface non-uniformity of a polished process layer on a wafer.

The interface module 92 may be used to couple the controller 84 to the polishing tool 20 and other devices in the system 72. Those skilled in the art will appreciate that the interface module 92 may be comprised of a variety of devices, and in one embodiment, the interface module 92 is an Advanced Process Control Framework interface.

Figure 7:
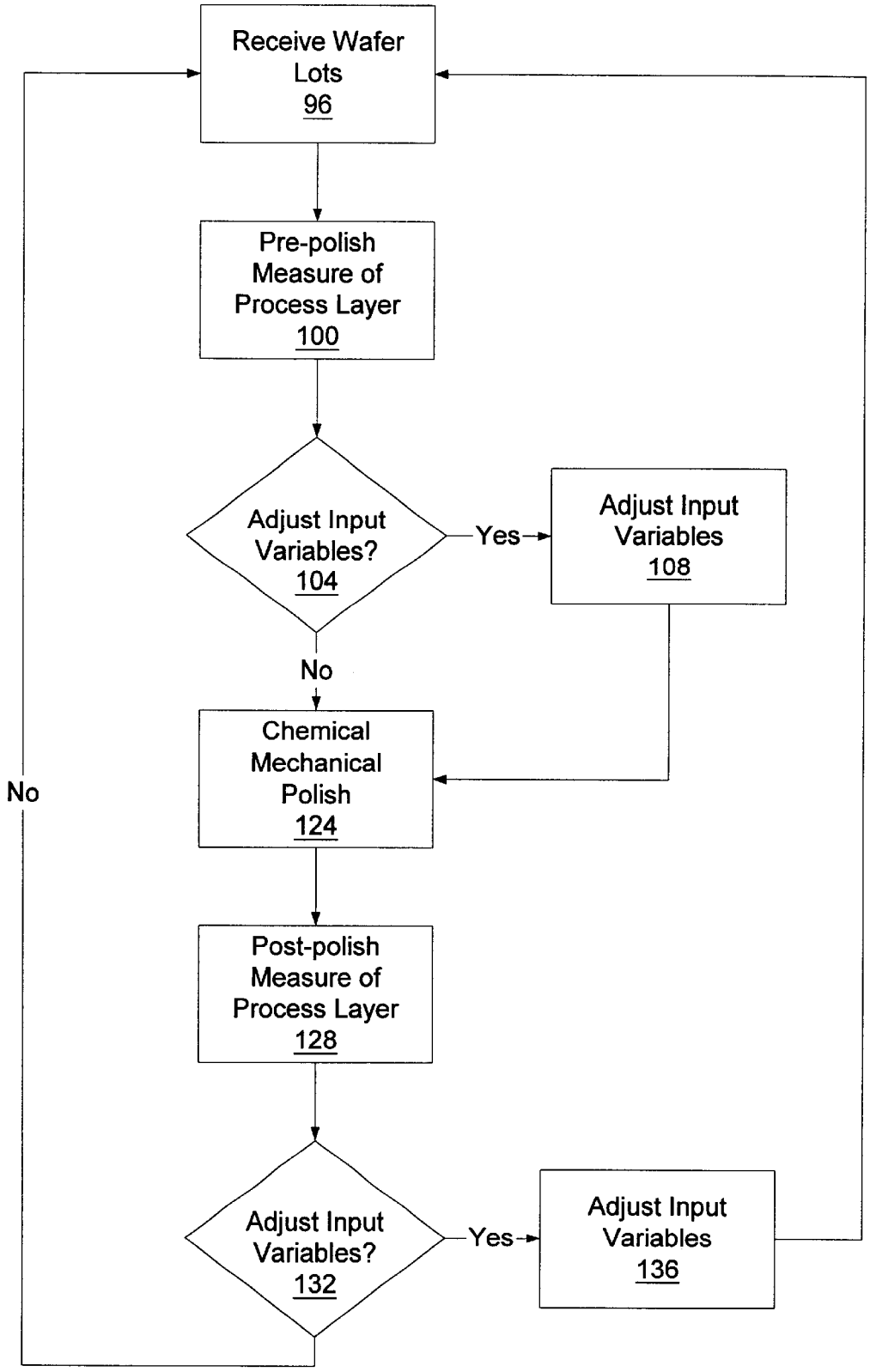
FIG. 7 is a flow chart illustrating an exemplary process for controlling within-wafer non-uniformity in accordance with one embodiment of the present invention.

An exemplary process flow for the system 72 is illustrated in FIG. 7. At block 96, a first lot of wafers (not shown) is received by the system 72. The first lot of wafers may be comprised of one or more wafers. For example, in one embodiment, the first lot of wafers may be comprised of 25 wafers. Moreover, as will be further illustrated below, rather than measuring the process layers of every wafer in a lot, a representative sample (e.g., 5 wafers) from the lot may be measured to represent the characteristics of the entire lot. Those skilled in the art will appreciate that the dimensions of the wafers may vary depending upon the application, and in one embodiment, the wafers have a diameter of approximately 200 mm. Moreover, the type of wafers received by the system 72 may vary depending upon the application. For example, in one embodiment, a lot of test wafers may be initially received to determine the appropriate settings for a particular process. Alternatively, production wafers may be received, and the processing tool 20 may be adjusted, as will be described below, based on the measured pre-polish and post-polish surface non-uniformity of the production wafers.

At block 100, a first measurement may be made of the wafer layer thickness to determine the pre-polish surface non-uniformity of the wafer. As was illustrated above, the pre-polish thickness of a process layer may be compared with the post-polish thickness the process layer to determine the state of the polishing process (e.g., center-fast, center-slow, etc.) For example, in one embodiment, the control variable is polish rate slope, and the polish rate slope is determined by measuring the pre-polish and post-polish thickness of the process layer at a plurality of radial points. In one embodiment, the thickness of the process layer is measured using an ellipsometer at 9 radial sites and a best-fit line is used to determine the pre-polish surface non-uniformity of the process layer.

In one illustrative embodiment, at block 104, the input variables may be adjusted to compensate for pre-polish surface non-uniformity of the first lot of wafers received at block 96. For example, if it is determined from the first measurement that the pre-polish surface non-uniformity of the process layer is indicative of a center-fast profile, the input variables of the polishing tool 20 may be adjusted to a center-slow polishing state. At a center-slow polishing state, the polishing tool 20 may compensate for the pre-polish surface non-uniformity of the process layer resulting in a more planar post-polish surface of the wafer. Moreover, the polishing tool 20 may be adjusted to a center-fast polishing state to compensate for a center-slow profile in surface non-uniformity of the process layer.

At block 108, the input variables (e.g., arm oscillation length and center position of the conditioning pad 64) may be adjusted based on the pre-polish surface non-uniformity of the first lot of wafers. In addition, as will be described below, the input variables may be further adjusted based on the polishing state of the polishing tool 20, which may be determined by polish rate slope.

Figure 8:
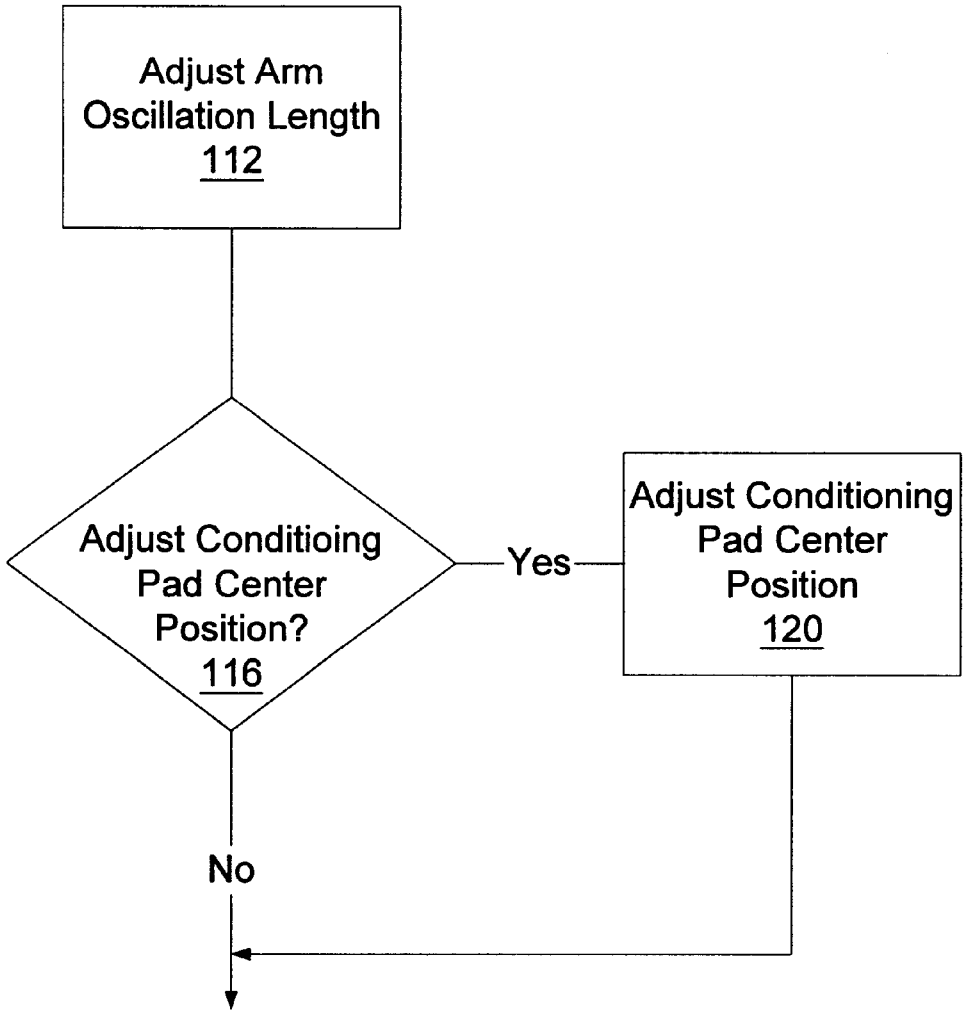
FIG. 8 is a flow chart illustrating an exemplary process for controlling within-wafer non-uniformity in accordance with one embodiment of the present invention.

Referring to FIG. 8, a more detailed exemplary illustration of block 108 is shown. At block 112, the optimizer module 88 of the controller 84 may determine an appropriate adjustment to arm oscillation length based on the pre-polish surface non-uniformity of the first lot of wafers. As described above, to produce wafers having a process layer with a more planar post-polish surface, the optimizer module 88 may increase or decrease arm oscillation length.

At block 116, to minimize surface non-uniformity of the first lot of wafers, the optimizer module 88 of the controller 84 may adjust the center position of the conditioning pad 64. As described above, in one embodiment, manipulation of the arm oscillation length may be constrained by minimum and maximum limits of oscillation. In this embodiment, if surface non-uniformity may no longer be controlled by manipulation of the arm oscillation length, the center position of the conditioning pad 64 may be adjusted, and the arm oscillation length may be re-centered between the minimum and maximum limits of arm oscillation length.

At block 120, depending upon the appropriate adjustment, the center position of the conditioning pad 64 may be moved toward the outer or inner edge 48, 44 of the polishing pad 28. Alternatively, if the surface non-uniformity of the process layer may be sufficiently eliminated by adjusting the arm oscillation length, the center position of the conditioning pad 64 may remain unchanged from its initial position. Generally, only arm oscillation length is manipulated prior to the first lot of wafers being polished. Moreover, both arm oscillation length and the center position of the condition pad 64 may be manipulated between successive lots of wafers (i.e., between first and second lots of wafers.)

The optimizer module 88 may determine appropriate adjustments to the input variables (e.g., arm oscillation length and the center position of the conditioning pad) using a variety of control algorithms. In one embodiment, measurements of the control variable from the metrology tool, 76, 80 may be provided to the controller 84, and the optimizer module 88 may determine the appropriate adjustments to the input variables using, among other things, model predictive control. For example, using model predictive control, the controller 84 may adjust the arm oscillation length and the center position of the conditioning pad 64 on a run-to-run basis. In this illustrative embodiment, a first lot of wafers may be polished, and based on measurements of the control variable from the first lot of wafers, the input variables may be adjusted before polishing a second lot of wafers.

Using model predictive control, the basic state-space formulation for tracking the polish rate slope of one of the polishing arms 36 of a Speedfam® polishing device 20 is:

$$x_{k+1} = \begin{bmatrix} 0 & 0 & 0 & 0 \\ 0 & 0.92 & 0 & 0 \\ 0 & 0 & 1 & 0 \\ 0 & 0 & 0 & 1 \end{bmatrix} x_k + \begin{bmatrix} -0.66 & 0 \\ 0 & 0.0075 \\ 0 & 0 \\ 0 & 0 \end{bmatrix} u_k \tag{2}$$

$$y_k = [1 \quad 1 \quad 1 \quad 1]x_k$$

In Equation (2), the first state represents the change affected by adjusting the first input variable, arm oscillation length. The second state represents the change in the condition of the polishing pad 28 produced by a change in the center position of the conditioning pad 64, which is the second input variable. The third and fourth states are a feedforward disturbance and a step disturbance in the output, respectively. It is contemplated that the third and fourth states are not part of the explicit process model but may be used to compensate for feed-forward disturbances and process noise typically experienced in polishing applications. For example, the feedforward state compensates for incoming wafer topography and may be directly measured before each polish run. Moreover, the final state is an unknown step disturbance, which may compensate for the nominal condition of the polishing pad 28 before any conditioning and may be used to ensure integral action in the controller. The inputs to the state-space model are the arm oscillation length $u_1$ and the conditioning pad center position $u_2$. Those skilled in the art will appreciate that Equation (2) characterizes a single polishing arm 36 and that similar equations may be used for each of the five polishing arms 36 of the Speedfam® polishing device 20. Moreover, the resulting state-space model may include twenty states, five outputs, and two inputs.

In this illustrative embodiment, the optimization equation for the controller may be given by:

$$\min_{u^1} J = y_{k+1}^T 10 I_5 y_{k+1} + u_{k+1}^T \begin{bmatrix} 0 & 0 \\ 0 & 1 \end{bmatrix} u_{k+1} \tag{3}$$

where $I_5$ is a 5×5 identity matrix. It is contemplated that Equation (3) is constrained by the process model of Equation (2) and the following inequality constraint:

$$\begin{bmatrix} 1 & 0 \\ -1 & 0 \\ 0 & 1 \\ 0 & -1 \end{bmatrix} u_k \le \begin{bmatrix} L_U \\ L_L \\ P_U \\ P_L \end{bmatrix} \tag{4}$$

where $L_U$ and $L_L$ are the upper and lower limits of the allowable arm oscillation length and $P_U$ and $P_L$ are the upper and lower limits of the center position of the conditioning pad 64. In this embodiment, the position of the conditioning pad 64 is given a penalty weight in the optimization equation, Equation (3). Because of the penalty weight, the controller 84 only manipulates the position of the conditioning pad 64 if an arm oscillation length within $L_U$ and $L_L$ is not found that minimizes the variation in polish rate slope of each of the five polishing arms 36.

Referring back to FIG. 7, the first lot of wafers is polished, at block 124. Once the first lot of wafers is polished, at block 128, a second measurement of the process layer thickness may be made to determine the polishing state of the polishing tool 20. As described above, rather than measuring each wafer in the first lot, a representative group of wafers may be measured from the first lost, and the control variable for the first lot may be determined from the measurements of the representative group. For example, in one embodiment, a lot of wafers is comprised of 25 wafers, and a representative group from the lot is comprised of 5 wafers. To determine the state of the polishing tool 20, the second measurement (e.g., post-polish thickness of the process layer) may be compared with the first measurement (eg., pre-polish thickness of the process layer), and in one embodiment, the polish rate slope of the process layer may be determined.

At block 132, depending upon the polish rate slope for the polished process layers, the input variables may be adjusted to minimize surface non-uniformity of subsequent process layers (e.g., a lot of wafers.) As described above, at block 136, the arm oscillation length and the center position of the conditioning pad 64 may be adjusted to produce process layers with a uniform polished surface. Those skilled in the art will appreciate that because of a variety of factors, such as queue time, computation time, etc., the input variables may not be adjusted for each successive run of wafers. Rather, depending upon the application, the controller 84 may minimize surface non-uniformity of the process layers for a particular run of wafers using whatever information is available from the polishing process.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A method of controlling surface non-uniformity of a process layer, comprising:

receiving a first lot of wafers;

performing polishing operations on a process layer of the first lot of wafers;

measuring a control variable of the polishing operations after the polishing is performed on the process layer;

determining a first adjustment input for an arm oscillation length of a wafer carrier of a polishing assembly based on the measurement of the control variable; and performing polishing operations on a process layer in a second lot of wafers using the determined first adjustment input for the arm oscillation length.

2. The method of claim 1, further comprising:

determining an adjustment input for a center position of a conditioning pad based on the measurement of the control variable;

manipulating the center position of the conditioning pad from a first position to a second position by the determined adjustment input for the conditioning pad; and preferentially conditioning a polishing pad with the conditioning pad located in the second position.

3. The method of claim 2, wherein the arm oscillation length is constrained by minimum and maximum limits of oscillation, and the center position of the conditioning pad is adjusted to re-center the arm oscillation length between the minimum and maximum limits of oscillation.

4. The method of claim 3, wherein the arm oscillation length is re-centered between the minimum and maximum limits of oscillation by preferentially conditioning the polishing pad to a center-fast state.

5. The method of claim 3, wherein the arm oscillation length is re-centered between the minimum and maximum limits of oscillation by preferentially conditioning the polishing pad to a center-slow state.

6. The method of claim 2, wherein moving the center position of the condition pad toward the center of the polishing pad produces a center-slow polishing state.

7. The method of claim 2, wherein moving the center position of the conditioning pad away from the center of the polishing pad produces a center-fast polishing state.

8. The method of claim 1, further comprising:

measuring a pre-polish surface non-uniformity of the first lot of wafers;

determining a second adjustment input for the arm oscillation length of the wafer carrier of the polishing assembly based on the measured pre-polish surface non-uniformity of the first lot of wafers; and performing polishing operations on the process layer of the first lot of wafers using the determined second adjustment input for the arm oscillation length.

9. The method of claim 1, wherein the control variable is polish rate slope, and the polish rate slope is determined by measuring a pre-polish and a post-polish thickness of the process layer of the first lot of wafers at a plurality of radial positions and comparing the pre-polish measurements with the post-polish measurements at substantially the same radial positions.

10. The method of claim 1, wherein increasing the arm oscillation length produces a center-fast polishing state.

11. The method of claim 1, wherein decreasing the arm oscillation length produces a center-slow polishing state.

12. The method of claim 1, wherein determining the first adjustment input for arm oscillation length includes minimizing an optimization equation based on model predictive control.

13. The method of claim 1, wherein determining the first adjustment input for the arm oscillation length of the wafer carrier of the polishing assembly includes determining the arm oscillation length using a software application interfaced with the polishing tool.

14. A method of controlling surface non-uniformity of a process layer, comprising:

receiving a first lot of wafers;

performing polishing operations on a process layer of the first lot of wafers;

measuring a control variable of the polishing operations after the polishing is performed on the process layer;

determining an adjustment input for a center position of a conditioning pad based on the measurement of the control variable;

manipulating the center position of the conditioning pad from a first position to a second position by the determined adjustment input for the conditioning pad;

preferentially conditioning a polishing pad with the conditioning pad located in the second position; and performing polishing operations on a process layer in a second lot of wafers using the preferentially conditioned polishing pad.

15. The method of claim 14, wherein moving the center position of the condition pad toward the center of the polishing pad produces a center-slow polishing state.

16. The method of claim 14, wherein moving the center position of the conditioning pad away from the center of the polishing pad produces a center-fast polishing state.

17. The method of claim 14, wherein determining the adjustment input for the center position of the conditioning pad includes minimizing an optimization equation based on model predictive control.

18. The method of claim 14, wherein determining the adjustment input for the center position of the conditioning pad includes determining the center position of the conditioning pad using a software application interfaced with the polishing tool.

19. A controller for controlling surface non-uniformity of a process layer, comprising:

an optimizer adapted to determine a first adjustment input for arm oscillation length of a wafer carrier of a polishing assembly based on a measurement of a control variable from a first lot of wafers; and an interface adapted to provide the first adjustment input to the polishing tool for polishing a second lot of wafers.

20. The controller of claim 19, wherein the optimizer is adapted to determine an adjustment input for a center position of a conditioning pad based on the measurement of the control variable.

21. The controller of claim 20, wherein the optimizer is adapted to re-center the arm oscillation length between minimum and maximum limits of oscillation.

22. The controller of claim 20, wherein the optimizer is adapted to move the center position of the condition pad away from a center of a polishing pad to produce a center-fast polishing state.

23. The controller of claim 20, wherein the optimizer is adapted to move the center position of the conditioning pad toward a center of a polishing pad to produce a center-slow polishing state.

24. The controller of claim 19, wherein the optimizer is adapted to determine a second input adjustment for arm oscillation length of the polishing tool based on a measured pre-polish surface non-uniformity of the first lot of wafers and provide the second adjustment input to the polishing tool for polishing of the first lot of wafers.

25. The controller of claim 19, wherein the optimizer is adapted to increase the arm oscillation length to produce a center-fast polishing state.

26. The controller of claim 19, wherein the optimizer is adapted to decrease the arm oscillation length to produce a center-slow polishing state.

27. The controller of claim 19, wherein the optimizer is adapted to determine the first adjustment input for arm oscillation length by minimizing an optimization equation based on model predictive control.

28. The controller of claim 19, wherein the optimizer module is adapted to determine the first adjustment input for the arm oscillation length of the wafer carrier of the polishing assembly using a software application interfaced with the polishing tool.

* * * * *